US005531575A

United States Patent [19]

Lin

[11] Patent Number: 5,531,575

[45] Date of Patent: Jul. 2, 1996

[54] HAND PUMP APPARATUS HAVING TWO PUMPING STROKES

[76] Inventor: Gi S. Lin, No. 2,296 Lane Ming Sheng Rd, Wu Feng Hsiang, Taichung, Taiwan

[21] Appl. No.: 506,329

[22] Filed: Jul. 24, 1995

[51] Int. Cl.[6] ..... F04B 21/04

[52] U.S. Cl. ..... 417/526; 417/534; 417/553; 91/422; 251/900

[58] Field of Search ..... 417/525, 526, 417/527, 534, 553; 91/222, 422; 251/325, 900

[56] References Cited

U.S. PATENT DOCUMENTS 2,410,808 11/1946 Christensen ..... 417/526

3,904,325 9/1975 Olofsson et al. ..... 417/525

5,449,278 9/1995 Lin ..... 417/526

*Primary Examiner*—Charles Freay

*Attorney, Agent, or Firm*—Charles E. Baxley

[57] ABSTRACT

A hand pump includes a housing having two chambers communicated with each other. An attachment member is secured to the front portion of the housing. A piston is slidably engaged in one of the chambers and includes two annular grooves for receiving two sealing rings. A piston rod has one end secured to the piston and has the other end extended outward of the housing. The piston may pump the air in front of the piston into the attachment member when the piston moves forward, and the air in the rear portion of the piston may be pumped into the attachment member via the other chamber.

1 Claim, 4 Drawing Sheets

HAND PUMP APPARATUS HAVING TWO PUMPING STROKES

BACKGROUND OF THE INVENTION

1. Field of the Invention

The present invention relates to a hand pump apparatus, and more particularly to a hand pump apparatus having two pumping strokes.

2. Description of the Prior Art

Typical hand pumps comprise a cylindrical member having a piston slidably engaged therein and having a piston rod secured to the piston for moving the piston in a reciprocating action within the cylindrical member for pumping air. However, normally, the air may be pumped only when the piston is pushed forward of the cylindrical member. The piston may not pump air when moving rearward.

The present invention has arisen to mitigate and/or obviate the afore-described disadvantages of the conventional hand pumps.

SUMMARY OF THE INVENTION

The primary objective of the present invention is to provide a hand pump apparatus which may pump air when the piston moves either forward or rearward of the cylindrical member.

In accordance with one aspect of the invention, there is provided a hand pump apparatus comprising a housing including a partition provided therein so as to separate the housing into a first chamber and a second chamber, the partition including a rear portion having a hole formed therein for communicating the first chamber with the second chamber, the housing including a rear portion and including a front portion having a first passageway and a second passageway formed therein and communicating with the first chamber and the second chamber respectively, an attachment member secured to the front portion of the housing and including a bore communicating with the first chamber and the second chamber via the first and second passageways, check valve means for allowing air to flow into the attachment via the first and second passageways and for preventing air from flowing into the first and second chambers via the first and the second passageways, a piston slidably engaged in the second chamber so as to separate the second chamber into a front room and a rear room, the piston including a front annular groove and a rear annular groove formed therein so as to define a front ring and a middle ring and a rear ring, the piston including an aperture formed in the middle ring and communicating with the annular grooves, the front ring and the rear ring each including a cut off portion formed therein for communicating the annular rings with the front room and the rear room respectively, a first sealing ring and a second sealing ring engaged in and movable in the front annular groove and the rear annular groove respectively, and a piston rod slidably engaging in the rear portion of the housing and including a first end secured to the piston and including an orifice formed in the first end thereof and communicating with the aperture of the piston, the piston rod including a hollow interior and including a second end extended outward of the housing. The first sealing ring is engaged with the middle ring of the piston so as to make an air tight seal between the housing and the piston when the piston moves forward toward the attachment member. The air received in the front room is pumped into the attachment member via the second passageway and the check valve means. The second sealing ring is engaged with the rear ring of the piston when the piston moves forward toward the attachment member such that air is allowed to flow into the rear room via the hollow interior of the piston rod and the orifice and the aperture and the rear annular groove and the cut off portion of the rear ring. The second sealing ring is engaged with the middle ring of the piston so as to make an air tight seal between the housing and the piston when the piston moves rearward, the air received in the rear room is pumped into the attachment member via the hole and the first chamber and the first passageway and the check valve means. The first sealing ring is engaged with the front ring of the piston when the piston moves rearward such that air is allowed to flow into the front room via the hollow interior of the piston rod and the orifice and the aperture and the front annular groove and the cut off portion of the front ring.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
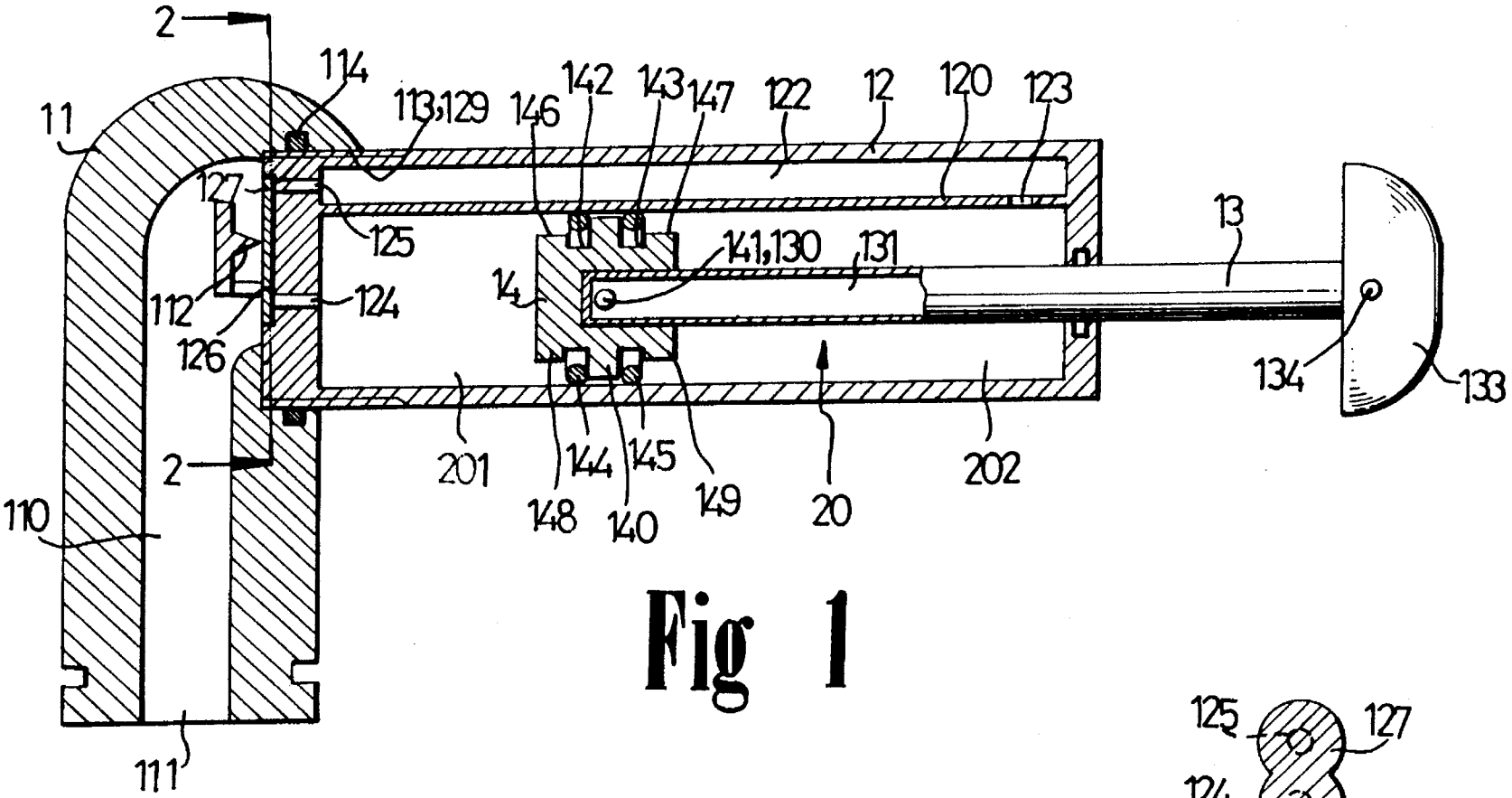
FIG. 1 is a cross sectional view of a hand pump apparatus in accordance with the present invention.
Figure 2:
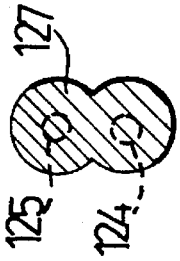
FIG. 2 is a cross sectional view taken along lines 2—2 of FIG. 1.

Referring to the drawings, and initially to FIG. 1, a hand pump apparatus in accordance with the present invention comprises a housing 12 including a partition 120 provided therein for separating the interior of the housing 12 into two chambers 122, 20. The partition 120 includes a rear end having a hole 123 formed therein for communicating the two chambers 122, 20. The housing 12 includes a front end having two passageways 124, 125 formed therein and communicating with the chambers 20, 122 respectively; and having a recess 126 formed in the front end for engaging with a substantially 8-shaped resilient plate 127 (FIG. 2) which is provided for engaging with the passageways 124, 125 and for forming check valves for the passageways 124, 125. The front end of the housing 12 includes an outer thread 129 for threadedly engaging with an inner thread 113 of an attachment member 11. The attachment member 11 includes a bore 110 formed therein and communicating with the chambers 122, 20 by the passageways 125, 124 respectively. The attachment member 11 includes-a mouth 111 for engaging with valve nipples or tire valves; and includes a tip member 112 secured therein for engaging with the middle portion of the resilient plate 127 such that the resilient plate 127 includes two end portions that may be moved toward or away from the passageways 124, 125 for enclosing or for opening the passageways 124, 125, best shown in FIGS. 3 and 4. The resilient plate 127 thus forms the check valves for the passageways 124, 125. A sealing ring 114 is engaged between the attachment member 11 and the housing 12 so as to make an air tight seal therebetween.

Figure 5:
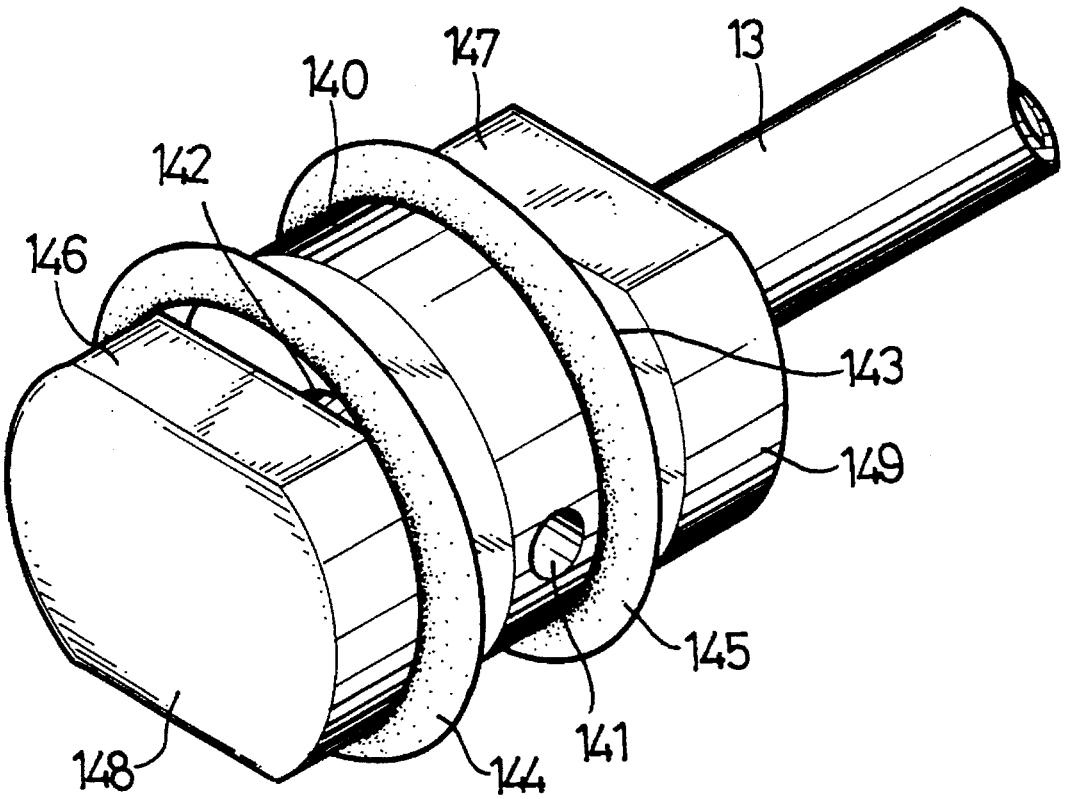
FIG. 5 is a perspective view showing a piston.

The chamber 20 is a cylindrical chamber having a piston 14 slidably engaged therein. The piston 14 separates the chamber 20 into a front room 201 and a rear room 202. As shown in FIG. 5, the piston 14 includes two annular grooves 142, 143 formed therein so as to define a front ring 148, a middle ring 140 and a rear ring 149. Two sealing rings 144, 145 are engaged in the annular grooves 142, 143 respectively and each has a size smaller than that of the annular grooves 142, 143 such that the sealing rings 144, 145 may move either forward or rearward of the annular grooves 142, 143. The piston 14 includes an aperture 141 formed in the middle ring 140 and communicating with the annular grooves 142, 143. The front ring 148 and the rear ring 149 each includes at least one cut off portion 146, 147 for communicating the rooms 201, 202 with the annular grooves 142, 143. A piston rod 13 is slidably engaged in the rear portion of the chamber 20 of the housing 12 and includes a front end secured to the piston 14 and includes an orifice 130 formed in the front end and communicating with the aperture 141 of the piston 14. The piston rod 13 includes a hollow interior 131 and includes a handle 133 secured to the rear end and includes an opening 134 formed in the rear end for communicating the hollow interior 131 with the environment.

Figure 3:
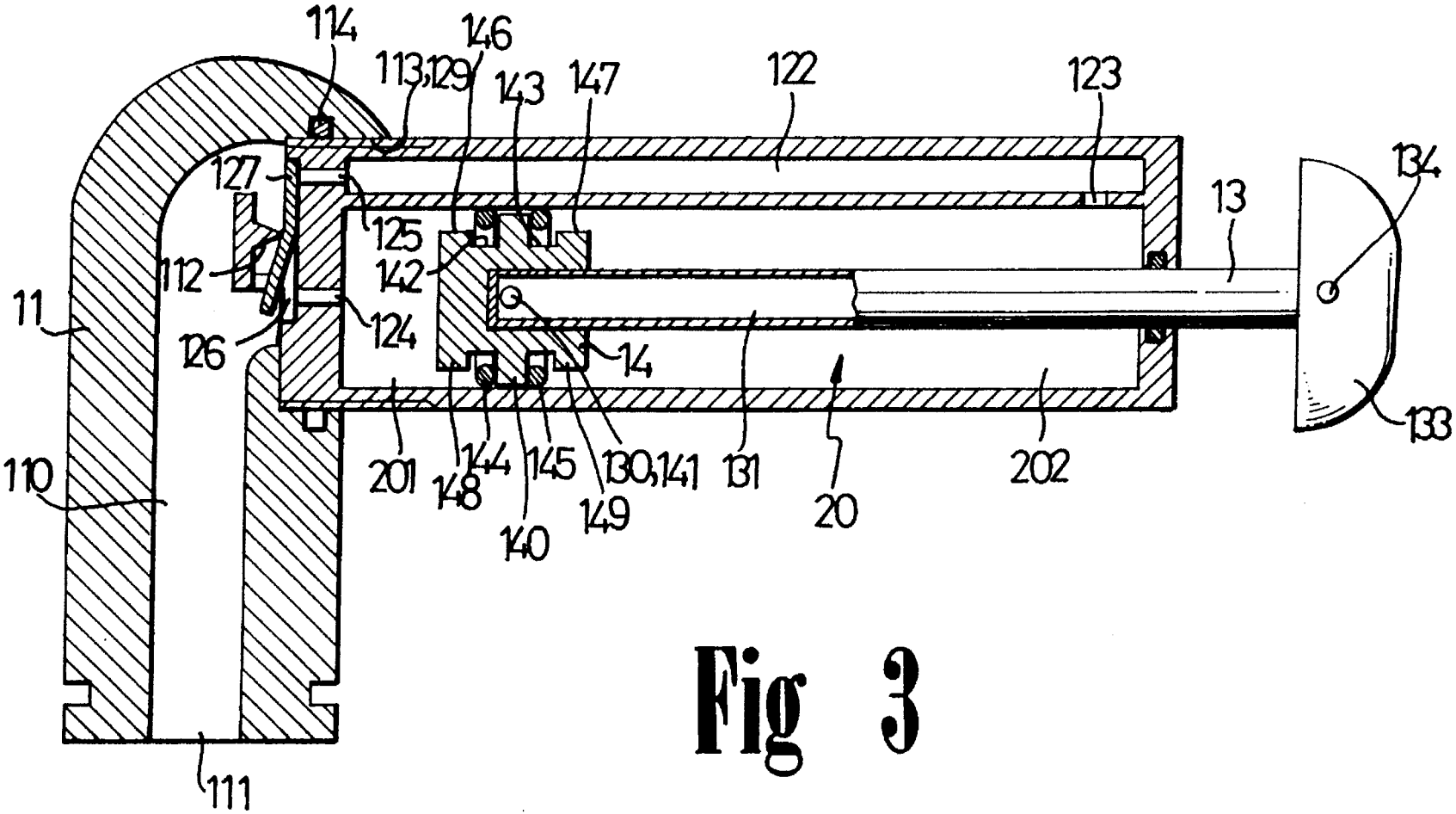
FIGS. 3 and 4 are cross sectional views similar to FIG. 1, illustrating the operation of the hand pump apparatus.

In operation, as shown in FIG. 3, when the piston rod 13 is pushed forward of the housing 12, the sealing rings 144, 145 may engage with the middle ring 140 and the rear ring 149 respectively. At this moment, an air tight seal is formed between the housing 12 and the middle ring 140 for enclosing the annular groove 142 such that the air received in the front room 201 may be pumped into the bore 110 of the attachment member 11 via the passageway 124 and the check valve 127. Simultaneously, when the piston 14 moves forward, the sealing ring 145 is engaged with the rear ring 149. However, the annular groove 143 may be communicated with the rear room 202 via the cut off portion 147 such that the air may flow into the rear room 202 via the opening 134 and the hollow interior of the piston rod 13, the orifice 130, the aperture 141, the annular groove 143 and the cut off portion 147.

Figure 4:
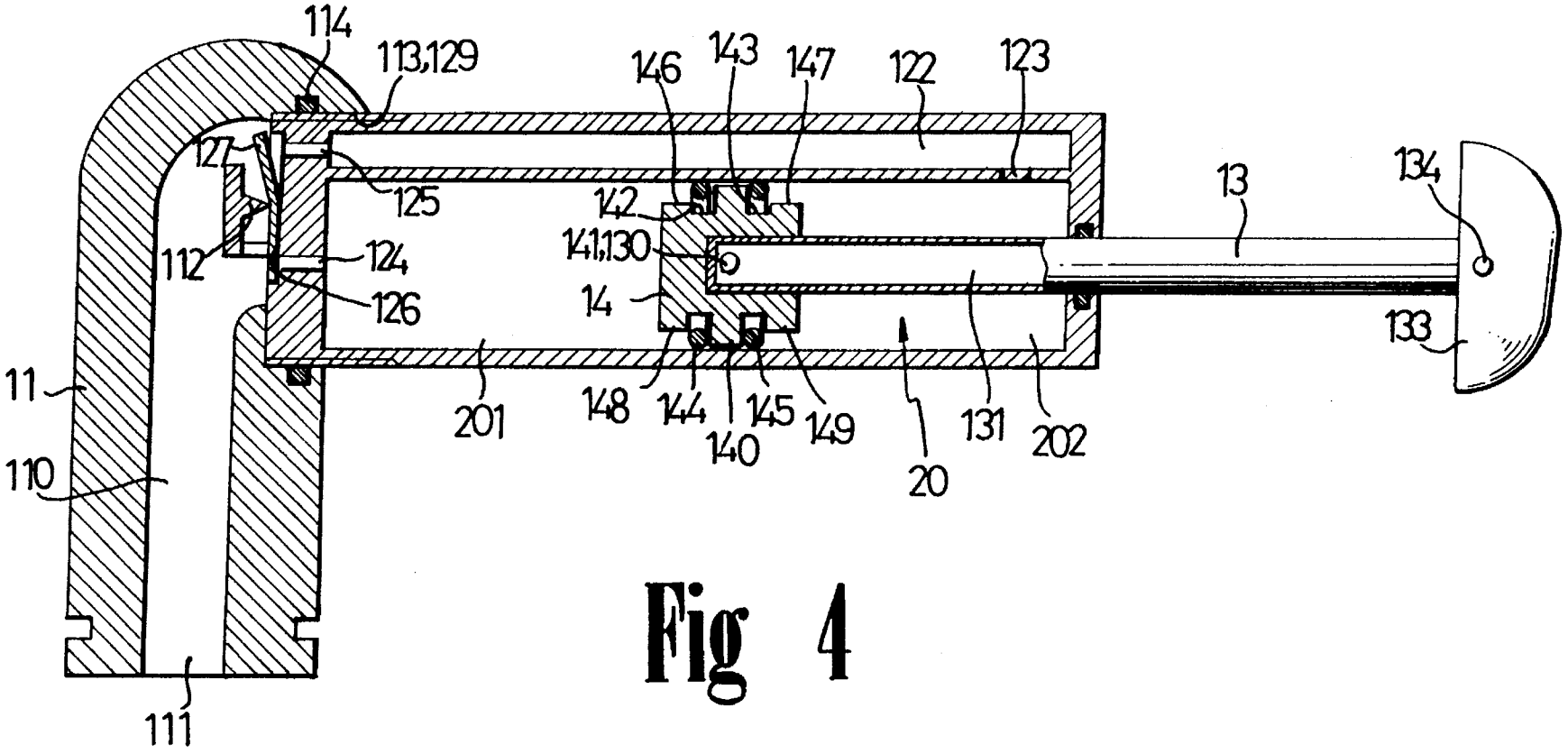

As shown in FIG. 4, when the piston rod 13 is moved rearward of the housing 12, the sealing rings 144, 145 may engage with the front ring 148 and the middle ring 140 respectively. At this moment, an air tight seal is formed between the housing 12 and the middle ring 140 for enclosing the annular groove 143 such that the air received in the rear room 202 may be pumped into the bore 110 of the attachment member 1l via the hole 23 and the chamber 122 and the passageway 125 and the check valve 127. Simultaneously, when the piston 14 moves rearward, the sealing ring 144 is engaged with the front ring 148. However, the annular groove 142 may be communicated with the front room 201 via the cut off portion 146 such that the air may flow into the front room 201 via the opening 134 and the hollow interior of the piston rod 13, the orifice 130, the aperture 141, the annular groove 142 and the cut off portion 146. The air received in the front room 201 may be pumped out of the housing 12 when the piston 14 is moved forward again.

Accordingly, the hand pump apparatus in accordance with the present invention includes a piston that may be provided for pumping air when the piston moves both forward and rearward.

Although this invention has been described with a certain degree of particularity, it is to be understood that the present disclosure has been made by-way of example only and that numerous changes in the detailed construction and the combination and arrangement of parts may be resorted to without departing from the spirit and scope of the invention as hereinafter claimed.

I claim:

1. A hand pump apparatus comprising:

a housing including a partition provided therein so as to separate said housing into a first chamber and a second chamber, said partition including a rear portion having a hole formed therein for communicating said first chamber with said second chamber, said housing including a rear portion and including a front portion having a first passageway and a second passageway formed therein and communicating with said first chamber and said second chamber respectively, an attachment member secured to said front portion of said housing and including a bore communicating with said first chamber and said second chamber via said first and second passageways, check valve means for allowing air to flow into said attachment via said first and second passageways and for preventing air from flowing into said first and second chambers via said first and said second passageways, a piston slidably engaged in said second chamber so as to separate said second chamber into a front room and a rear room, said piston including a front annular groove and a rear annular groove formed therein so as to define a front ring and a middle ring and a rear ring, said piston including an aperture formed in said middle ring and communicating with said annular grooves, said front ring and said rear ring each including a cut off portion formed therein for communicating said annular rings with said front room and said rear room respectively, a first sealing ring and a second sealing ring engaged in and movable in said front annular groove and said rear annular groove respectively, and a piston rod slidably engaging in said rear portion of said housing and including a first end secured to said piston and including an orifice formed in said first end thereof and communicating with said aperture of said piston, said piston rod including a hollow interior and including a second end extended outward of said housing, said first sealing ring being engaged with said middle ring of said piston so as to make an air tight seal between said housing and said piston when said piston moves forward toward said attachment member, an air received in said front room being pumped into said attachment member via said second passageway and said check valve means, said second sealing ring being engaged with said rear ring of said piston when said piston moves forward toward said attachment member, air being allowed to flow into said rear room via said hollow interior of said piston rod and said orifice and said aperture and said rear annular groove and said cut off portion of said rear ring, and said second sealing ring being engaged with said middle ring of said piston so as to make an air tight seal between said housing and said piston when said piston moves rearward, the air received in said rear room being pumped into said attachment member via said hole and said first chamber and said first passageway and said check valve means, said first sealing ring being engaged with said front ring of said piston when said piston moves rearward, air being allowed to flow into said front room via said hollow interior of said piston rod and said orifice and said aperture and said front annular groove and said cut off portion of said front ring.

* * * * *